US008910887B2

(12) United States Patent
Helmsderfer et al.

(10) Patent No.: US 8,910,887 B2
(45) Date of Patent: Dec. 16, 2014

(54) GARDEN WATERING DEVICE

(75) Inventors: John A. Helmsderfer, Cincinnati, OH (US); Nicholas Jeffers, Marysville, OH (US)

(73) Assignee: Partners In Innovation, Ltd., Cincinnati, OH (US)

( * ) Notice: Subject to any disclaimer, the term of this patent is extended or adjusted under 35 U.S.C. 154(b) by 395 days.

(21) Appl. No.: 13/184,325

(22) Filed: Jul. 15, 2011

(65) Prior Publication Data

US 2012/0126027 A1 May 24, 2012

Related U.S. Application Data

(60) Provisional application No. 61/364,680, filed on Jul. 15, 2010.

(51) Int. Cl.

| | |
|---|---|
| ***B05B 15/00*** | (2006.01) |
| ***B05B 17/00*** | (2006.01) |
| ***B05B 1/16*** | (2006.01) |
| ***B05B 15/06*** | (2006.01) |
| ***B05B 1/02*** | (2006.01) |
| *B05B 3/04* | (2006.01) |

(52) U.S. Cl.

CPC ..... *B05B 1/02* (2013.01); *B05B 1/1654* (2013.01); *B05B 15/069* (2013.01); *B05B 3/0431* (2013.01); *B05B 15/063* (2013.01)

USPC ..... 239/289; 239/393; 239/397; 239/438; 239/444; 239/446

(58) Field of Classification Search

CPC ..... B05B 3/044; B05B 1/1654; B05B 1/645

USPC ..... 239/289, 242, 394, 392, 393, 397, 436, 239/438, 444, 446

See application file for complete search history.

(56) References Cited

U.S. PATENT DOCUMENTS

| | | | |
|---|---|---|---|
| 924,519 | A | 6/1909 | Wooding |
| 941,109 | A | 11/1909 | Sutherland |
| 1,007,657 | A | 10/1911 | Freund |
| 1,026,742 | A | 5/1912 | French |

(Continued)

FOREIGN PATENT DOCUMENTS

| | | | |
|---|---|---|---|
| EP | 0826427 | A2 | 3/1998 |
| WO | 2011075660 | A1 | 6/2011 |

OTHER PUBLICATIONS

Eighteen-page International Search Report and Written Opinion mailed Feb. 14, 2011 for PCT/US2010/061063.

*Primary Examiner* — Dinh Q Nguyen

(74) *Attorney, Agent, or Firm* — Wood, Herron & Evans, LLP

(57) ABSTRACT

A multi-purpose watering device that operates as a handheld device and ground based watering device. The device consists of a long handle leading to a turret sprinkler with water distribution on at least two sides. One side is used in a ground based position to water small to medium area lawns and the other is used for watering when the device is used in a held position. A valve on the turret face allows the operator to switch select which will distribute water. The device also contains a rotating sprinkler head suited for watering of large areas. When the rotating head is actuated, water is redirected from the turret head to the rotating head.

10 Claims, 6 Drawing Sheets

(56) References Cited

U.S. PATENT DOCUMENTS

| | | | | |
|---|---|---|---|---|
| 1,031,176 | A | 7/1912 | Gilpin | |
| 1,058,189 | A | 4/1913 | Moboyle | |
| 1,078,817 | A | 11/1913 | Austin | |
| 1,168,219 | A | 1/1916 | Miller | |
| 1,566,232 | A | 12/1925 | Schreiter | |
| 1,612,326 | A | 12/1926 | Taylor | |
| 2,053,931 | A | 9/1936 | Work | |
| 2,620,232 | A | 12/1952 | King | |
| 2,770,826 | A | 11/1956 | Curfman | |
| 3,115,305 | A | 12/1963 | Rinkcwich | |
| 3,332,624 | A | 7/1967 | Rinkcwich | |
| 3,354,730 | A | 11/1967 | Thompson | |
| 3,630,450 | A | 12/1971 | Stephany et al. | |
| 4,130,135 | A | 12/1978 | Moore | |
| 4,347,981 | A | 9/1982 | Hayes | |
| 4,421,276 | A | 12/1983 | Rodgers | |
| 4,708,291 | A | 11/1987 | Grundy | |
| 4,903,897 | A | 2/1990 | Hayes | |
| 5,160,093 | A | 11/1992 | Battaglia | |
| 5,174,501 | A | 12/1992 | Hadar | |
| 5,305,956 | A | 4/1994 | Wang | |
| 5,947,388 | A | 9/1999 | Woodruff | |
| 6,123,272 | A | 9/2000 | Havican et al. | |
| 6,398,185 | B1 | 6/2002 | Wang | |
| 6,554,209 | B2 | 4/2003 | Djordjevic | |
| 6,619,570 | B1 | 9/2003 | Ericksen et al. | |
| 6,663,022 | B1 | 12/2003 | Baker | |
| 6,712,294 | B1 | 3/2004 | Wang | |
| 7,028,984 | B2 | 4/2006 | Wang | |
| 7,140,561 | B2 | 11/2006 | Heren et al. | |
| D536,062 | S | 1/2007 | Hester | |
| 7,252,246 | B2 | 8/2007 | Heren et al. | |
| 7,448,558 | B2 * | 11/2008 | Wang | 239/394 |
| 2004/0222320 | A1 | 11/2004 | Wu | |
| 2006/0214023 | A1 * | 9/2006 | Collins et al. | 239/242 |
| 2007/0290071 | A1 * | 12/2007 | Wang et al. | 239/275 |
| 2012/0126027 | A1 | 5/2012 | Helmsderfer et al. | |
| 2012/0223153 | A1 | 9/2012 | Helmsderfer et al. | |
| 2013/0037624 | A1 | 2/2013 | Helmsderfer et al. | |

* cited by examiner

GARDEN WATERING DEVICE

CROSS-REFERENCE TO RELATED APPLICATIONS

This application claims priority to U.S. Provisional Application No. 61/364,680 by Helmsderfer et al. filed Jul. 15, 2010 and hereby incorporated by reference in its entirety.

FIELD OF THE INVENTION

The present invention relates to garden watering devices and, more particularly, to a combination sprinkler device having multiple water distribution features.

BACKGROUND OF THE INVENTION

The watering of lawns, landscape areas and potted plants requires a number of watering devices. The production of these devices requires resources to manufacture and result in additional expense to the consumer. Consumers are interested in saving time, reducing clutter, and acquiring watering devices that offer them more value. In addition, consumers are unlikely to compromise their requirements for specific spray patterns for specific tasks. Retailers are interested in conserving shelf space and increasing revenue per square foot of store area.

A device is therefore needed that addresses these consumer requirements while providing high value for retailers.

SUMMARY OF THE INVENTION

The objective of the present invention is to offer a garden watering device that incorporates the aforementioned benefits to both consumers and retailers by providing the functionality of multiple spray patterns incorporated by means of a turret dial within a turret dial. Storage space in a consumer's garage or garden shed is reduced by incorporating a rotary sprinkler such as a gear drive or impulse head that folds into the device body for storage when not in use.

Furthermore, by combining multiple spray dials within a single article, raw materials and other manufacturing resources are conserved at many levels of the manufacturing process. Moreover, through these combinations, the retailer recognizes the economic and operational benefits of conserving retail merchandising and stock space.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

FIGS. 1-6 depict a water sprinkler having a turret-style head that features a turret dial within the turret dial.

Figure 1:
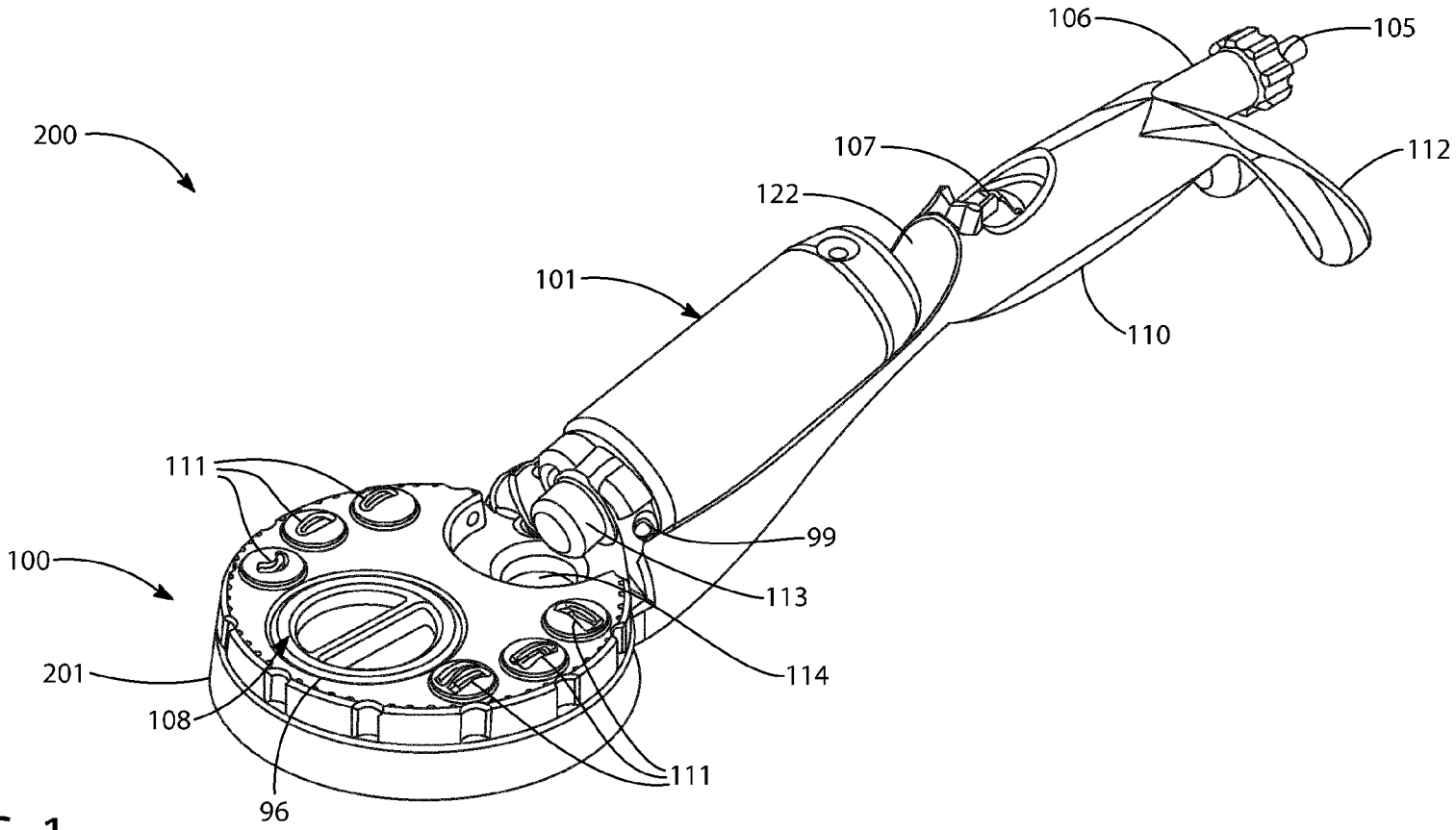
FIG. 1 is a perspective view of a sprinkler in accordance with one embodiment of the invention showing the rotating head mechanism in a disengaged position.

As shown in FIG. 1, the water sprinkler device 200 includes a two-sided turret head 100 and a device body 120. The device body 120 has a water inlet valve 105 attached to a tubular member 106. The tubular member 106 includes a valve 107 for controlling the water flow.

A rotating sprinkler head 101, which may be a rotating gearbox-style sprinkler head, is shown in FIG. 1 in a disengaged position within a recess 122 within the device body 120. When disengaged, the rotating sprinkler head 101 may sit substantially parallel to the device body 120, reducing the height and profile of the device 200. The rotating head may be a gear drive sprinkler such as one reflected in U.S. Pat. No. 5,174,501 to Hadar, hereby incorporated by reference in its entirety. It will be understood that types of rotating sprinkler heads other than the gear drive sprinkler could be used.

Figure 5:
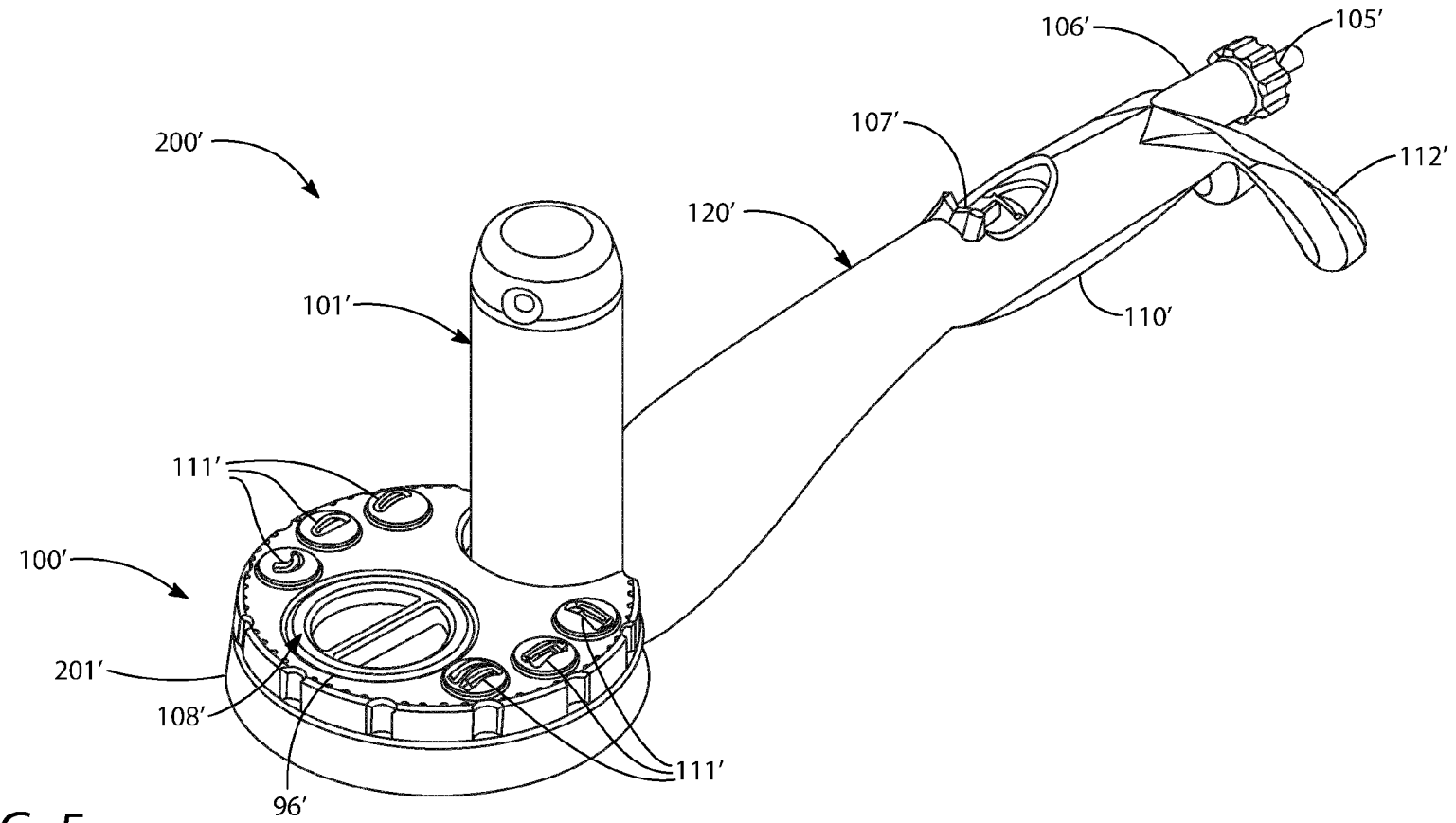
FIG. 5 is a perspective view of a sprinkler with a fixed rotating head in accordance with another embodiment of the invention.

The turret head 100 includes a device base 201. The rotating sprinkler head 101 is attached to the device base 201 by a hinge member 99, which may be any hinge member or other method of moveably coupling the rotating sprinkler head 101 to device 200 as known the art, including any pivotal or slidable coupling. The angle of the pivot point may be such that the rotating head mechanism 101 can be laid flat against the sprinkler body 120 when not in use, or be moved into a position perpendicular to the body 120 when the rotating head device 101 is to be used in the ground-based position as shown in FIG. 5. By positioning the rotating head 101 in the upright position, a gasket 113 at the base of the rotating head 101 connects with a port 114 on the device body. Water is then directed into the gear drive head 101 via a water channel 98, shown in phantom, first passing through flow selector 107. The flow selector may include a ball valve, a barrel valve, or any other valve appropriate for controlling water flow as known to one of ordinary skill in the art.

When the rotating head 101 is disengaged as shown in FIG. 1, the flow of water will continue into the turret head 100. In one embodiment, the turret head has discharge points 111 along its upper surface. Rotating the upper turret head 100 allows the operator to select a variety of water discharge patterns associated with the different discharge points 111.

Turret type sprinkler heads are common hose end watering devices, and in terms of the routing of the water within the turret head itself to the various spray pattern outlets, U.S. Pat. No. 4,347,981 to Hayes would serve as an adequate example. The Hayes patent is herein incorporated by reference in its entirety.

Figure 2:
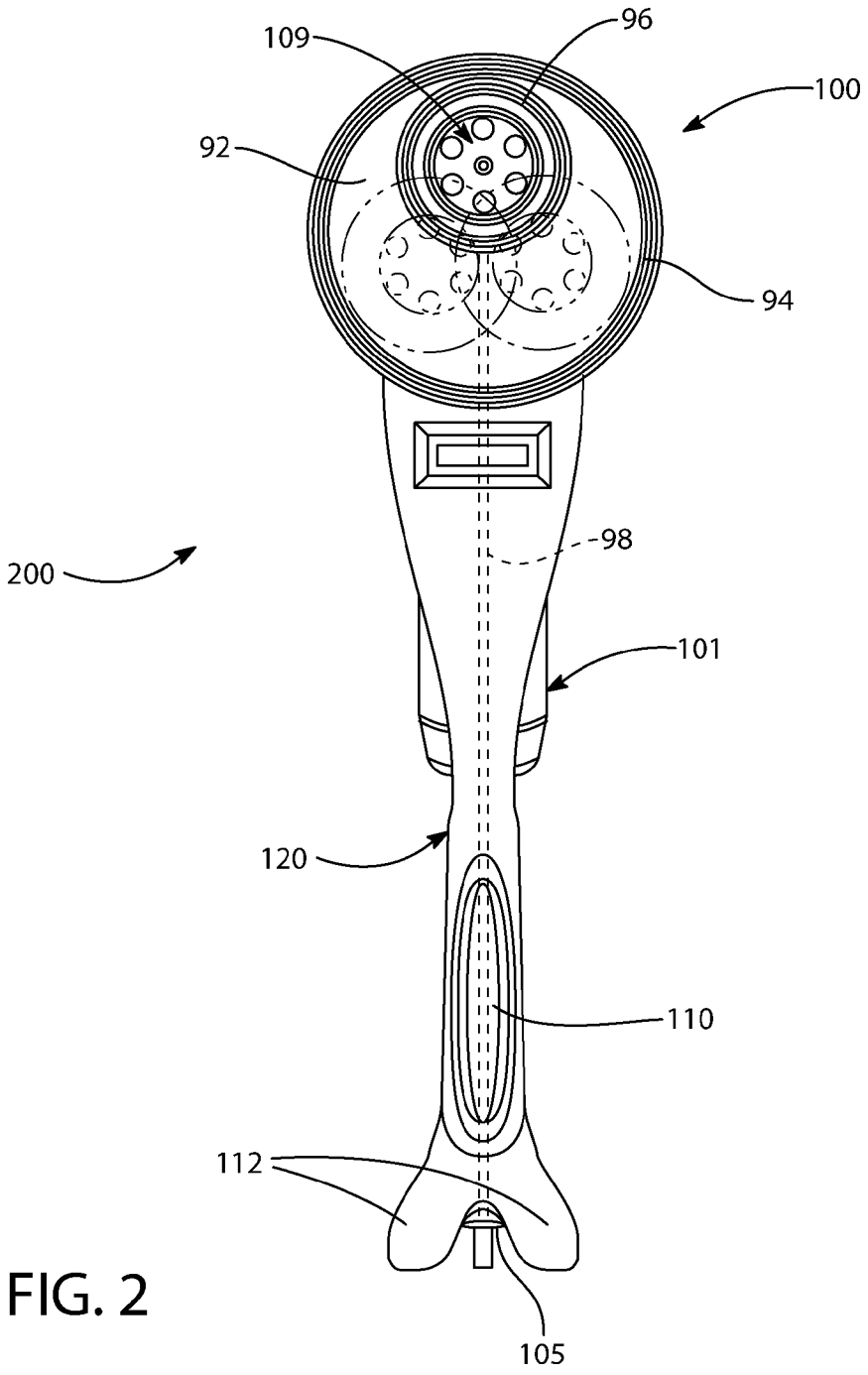
FIG. 2 is a bottom view of the sprinkler of FIG. 1.

As shown in more detail in FIG. 2, the turret head 100 contains a lower turret assembly 109 that is capable of discharging water through the bottom of the turret head 100. Referring back to FIG. 1, an inner turret dial 108 can be accessed through the upper surface of the turret head 100. The outside diameter of the inner turret dial 108 is less than the inside diameter of the aperture 96 within turret head 100 that receives the turret dial 108.

The turret head 100 resides within the device base 201, and can rotate within the device base 201, which allows selection of the water flow pattern among the upper discharge points 111 and the lower turret assembly 109. When turret head 100 is rotated so that turret dial 108 is aligned with the water outlet within the turret head 100, the water will be directed to the lower turret assembly 109. Rotation of the turret head 100 within the device base 201 may be similar to that disclosed within the '981 patent to Hayes previously referenced. The routing of water within the lower turret assembly 109 could be comparable to what is shown in U.S. Pat. No. 4,903,897, also to Hayes, which is hereby incorporated by reference in its entirety.

Figure 3:
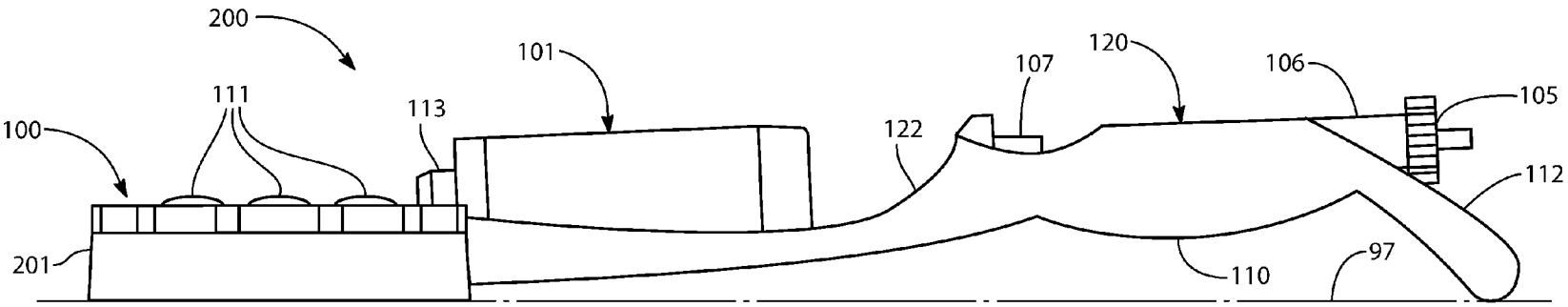
FIG. 3 is a side view of the sprinkler of FIG. 1.

As illustrated in FIG. 3, the device 200 also includes a support structure 112 located to the rear of the device body 120 and proximate the water inlet 105. This serves to elevate the body portion 120 of the sprinkler off the ground 97 to such an extent that an individual can easily place a hand between the body 120 and the ground 97 when the device body 120 rests on the ground 97. A grip 110 is disposed on the underside of the body 120, thus making the device easy to pick up and maintain the handle in position out of direct contact with the ground 97.

As shown in FIG. 2, the turret head 100 has a substantially flat bottom surface 92 that generally remains flush with the bottom edge of the device base 201 as does the lower turret assembly 109. The lower turret assembly 109 is free to move relative to turret body 100 by rotation of dial 108 as shown in FIG. 1 and described above. As the turret body 100 rotates, so too does the lower turret assembly 109.

FIG. 2 illustrates rotation of the lower turret assembly 109 by dashed lines 93 showing the assembly 109 in alternate positions. Call out 94 identifies the space between the outside diameter of turret head 100 and the inside diameter of device base. Accordingly, turret head 100 is able to rotate within the device base 201. As shown, the diameter of the upper part of the head 100 is greater than the lower part of the head 100, the lower part having a reduced diameter in order to fit within the base 201.

Lower turret assembly 109 may have a diameter generally less than the aperture 96 within which it sits; however, a component of the assembly 109, such as a gasket or O-ring (not shown), may protrude circumferentially beyond the diameter of the assembly 109 to interface with the aperture 96. Furthermore, this ring or other element may engage a receiving channel within aperture 96 passing through turret head 100. Other configurations will be recognized by those of ordinary skill in the art, such as a lower turret assembly 109 having an extreme upper or lower portion of its diameter, a portion that extends beyond the upper surface of turret head 100, a surface 92 such that the lower turret assembly 109 is effectively captured within the turret body 100 yet free to rotate by manual actuation of dial 108, or other interfaces between the lower turret assembly 109 and the rest of the turret head 100. The device base 201 will have a water outlet (internal, not shown) that admits water to the lower turret assembly 109 when it is properly aligned with water outlet as described above.

Figure 4:
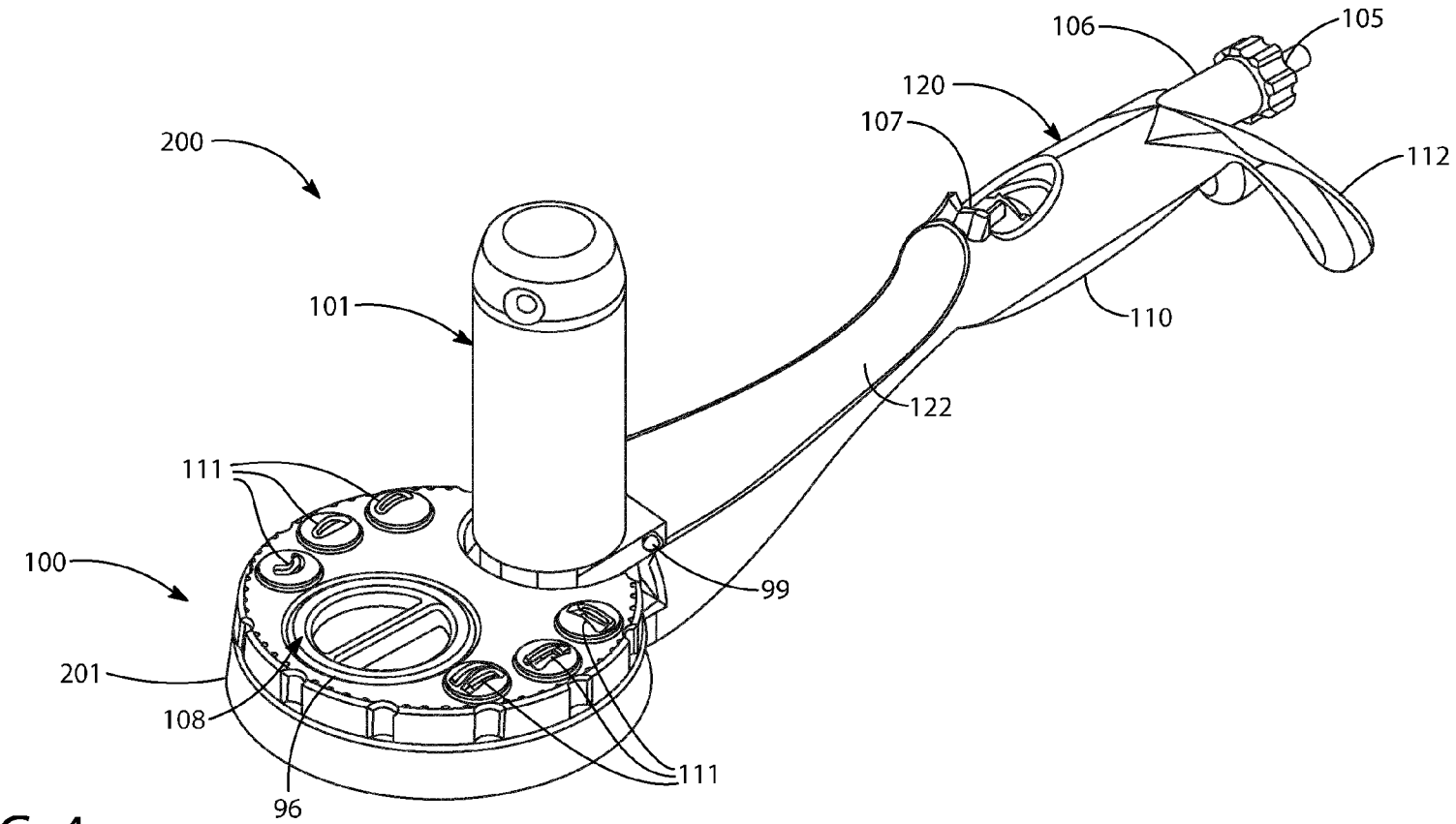
FIG. 4 is a perspective view of a sprinkler of FIG. 1 showing the rotating head mechanism in an engaged position.

FIG. 4 shows the sprinkler device 200 with the rotating head 101, in an operable vertical position. The rotating head 101 is shown as a gear drive sprinkler such as described in the aforementioned '981 patent to Hayes. Again, it will be understood that types of rotating sprinkler heads other than the gear drive sprinkler could be used.

FIG. 5 shows an alternative embodiment of the device 200' wherein like numbers denote similar features, and wherein the rotating head 101 is fixedly coupled to the turret head 100 in an integral fashion, omitting the hinge element 99 and the ability to move the rotating head 101 into a disengaged position. This permanent engagement can be accomplished as part of the manufacturing process or by means of a mechanical connection such as threads. In this embodiment 200', the rotating head 101 would not hingedly pivot from a use to a storage position; however, in some embodiments, the rotating head 101 may be able to disconnect from the device 200' altogether when not in use.

Figure 6:
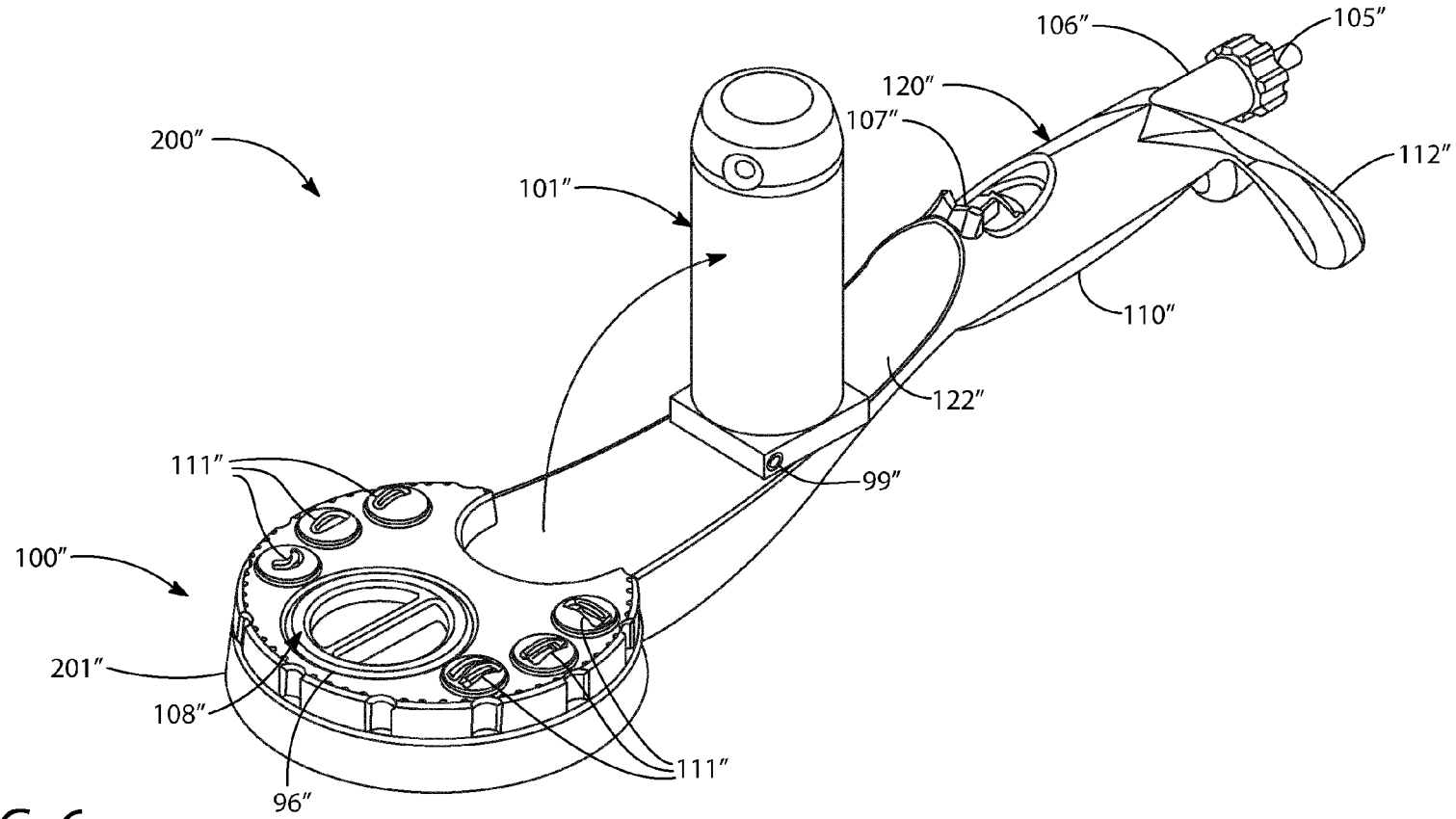
FIG. 6 is a perspective view of a sprinkler with a rotating head engaged in a different position in accordance with another embodiment of the invention.

FIG. 6 shows another embodiment of a sprinkler device 200" wherein the rotating head 101 is connected to the device body 120 rather than the turret head 101; the device is otherwise the same as that described and shown with respect to FIGS. 1-4.

Other teachings related to a gear drive sprinkler and its incorporation with a turret head for varying methods of dispensing water may be found in U.S. Provisional Application Nos. 61/287,524, 61/287,537, 61/287,519 and 61/498,411 and PCT Application No. US2010/061063 by Helmsderfer et al., each of which is hereby incorporated by reference in its entirety.

While the present invention has been illustrated by a description of various preferred embodiments and while these embodiments have been described in some detail, it is not the intention of the Applicant to restrict or in any way limit the scope of the appended claims to such detail. Additional advantages and modifications will readily appear to those skilled in the art. The various features of the invention may be used alone or in numerous combinations depending on the needs and preferences of the user.

What is claimed is:

1. A water sprinkler suitable for both ground-based and hand-held operation, comprising:

a handle portion, a water inlet, a first water discharge head, the first water discharge head being a turret-style head and including an upper surface having multiple spray patterns that can be selected by an operator for discharging water and a lower surface, the first water discharge head further including a turret assembly for discharging water from the lower surface, a second water discharge head capable of rotating by a rotating head mechanism, and a flow valve operable to direct water entering the sprinkler through the water inlet to the first and second water discharge heads.

2. The sprinkler of claim 1, wherein the first water discharge head rotates relative to the handle portion, the rotational position of the first water discharge head determining which of the multiple spray patterns will discharge water.

3. The sprinkler of claim 1, the second water discharge head including a gearbox, wherein the second water discharge head is operable to rotate by the pressure of water flowing through the gearbox.

4. A water sprinkler suitable for both ground-based and hand-held operation, comprising:

a handle portion, a water inlet, a first water discharge head, the first water discharge head being a turret-style head, a second water discharge head capable of rotating by a rotating head mechanism, the second water discharge head being operable to rotate between a first position nested within a recess in the handle portion and a second position operable to discharge water, and a flow valve operable to direct water entering the sprinkler through the water inlet to the first and second water discharge heads.

5. The sprinkler of claim 4, the first water discharge head including multiple spray patterns that can be selected by an operator for discharging water.

6. The sprinkler of claim 5, the first water discharge head including an upper surface having the multiple spray patterns and a lower surface, the first water discharge head further including a turret assembly for discharging water from the lower surface.

7. The sprinkler of claim 4, wherein the first water discharge head rotates relative to the handle portion, the rotational position of the first water discharge head determining which of the multiple spray patterns will discharge water.

8. The sprinkler of claim 4, the second water discharge head including a gearbox, wherein the second water discharge head is operable to rotate by the pressure of water flowing through the gearbox.

9. The sprinkler of claim 1, the turret assembly being rotatably moveable with respect to the first water discharge head.

10. The sprinkler of claim 9, the turret assembly including a dial for rotating the turret assembly.

* * * * *